US006156715A

United States Patent [19]

Lentsch et al.

[11] Patent Number: 6,156,715

[45] Date of Patent: Dec. 5, 2000

[54] STABLE SOLID BLOCK METAL PROTECTING WAREWASHING DETERGENT COMPOSITION

[75] Inventors: Steven E. Lentsch; Victor F. Man, both of St. Paul; Keith E. Olson, Apple Valley, all of Minn.

[73] Assignee: Ecolab Inc., St. Paul, Minn.

[21] Appl. No.: 09/089,095

[22] Filed: Jun. 2, 1998

Related U.S. Application Data

[63] Continuation-in-part of application No. 08/781,493, Jan. 13, 1997.

[51] Int. Cl.[7] ..... C11D 17/00; C11D 3/08; C11D 3/10; C11D 3/36; B08B 9/20

[52] U.S. Cl. ..... 510/224; 510/233; 510/445; 510/451; 510/469; 510/509; 510/510; 510/511; 510/512; 134/25.2

[58] Field of Search ..... 510/224, 298, 510/445, 233, 451, 469, 509, 510, 511, 512; 134/25.2

[56] References Cited

U.S. PATENT DOCUMENTS

| | | | |
|---|---|---|---|
| Re. 32,763 | 10/1988 | Fernholz et al. | 252/90 |
| 1,580,576 | 4/1926 | Weidner . | |
| 1,949,264 | 2/1934 | Bagley | 226/69 |
| 2,412,819 | 12/1946 | MacMahon | 252/138 |
| 2,920,417 | 1/1960 | Wertheimer | 45/25 |
| 2,927,900 | 3/1960 | Shiraeff | 252/152 |
| 2,987,483 | 6/1961 | Brooker | 252/138 |
| 3,306,858 | 2/1967 | Oberle | 252/99 |
| 3,351,558 | 11/1967 | Zimmerer | 252/137 |
| 3,382,178 | 5/1968 | Lissant et al. | 252/135 |
| 3,390,092 | 6/1968 | Keast et al. | 252/99 |
| 3,390,093 | 6/1968 | Feierstein et al. | 252/138 |
| 3,441,511 | 4/1969 | Otrhalek | 252/135 |
| 3,491,028 | 1/1970 | Crotty et al. | 252/103 |
| 3,557,003 | 1/1971 | Morris et al. | 252/90 |
| 3,639,286 | 2/1972 | Ballestra et al. | 252/109 |
| 3,816,320 | 6/1974 | Corliss | 252/99 |
| 3,846,346 | 11/1974 | Conn | 252/527 |
| 3,856,932 | 12/1974 | May | 424/16.21 |
| 3,887,614 | 6/1975 | Susuki et al. | 252/531 |
| 3,899,436 | 8/1975 | Copeland et al. | 252/99 |
| 3,933,670 | 1/1976 | Brill et al. | 252/99 |
| 3,936,386 | 2/1976 | Croliss et al. | 252/99 |
| 3,941,710 | 3/1976 | Gilbert et al. | 252/99 |
| 3,985,669 | 10/1976 | Krummel et al. | 252/116 |
| 4,000,080 | 12/1976 | Bartolotia et al. | 252/99 |
| 4,072,621 | 2/1978 | Rose | 252/89 |
| 4,083,795 | 4/1978 | Joubert | 252/99 |
| 4,105,573 | 8/1978 | Jacobsen | 252/99 |
| 4,147,650 | 4/1979 | Sabatellli et al. | 252/103 |
| 4,148,603 | 4/1979 | Schwuger et al. | 8/137 |
| 4,216,125 | 8/1980 | Campbell et al. | 252/527 |
| 4,219,436 | 8/1980 | Gromer et al. | 252/135 |
| 4,268,406 | 5/1981 | O'Brien et al. | 252/105 |
| 4,274,975 | 6/1981 | Corkill et al. | 252/140 |
| 4,276,205 | 6/1981 | Ferry | 252/528 |
| 4,284,532 | 8/1981 | Leikhim et al. | 252/528 |
| 4,329,246 | 5/1982 | Gilbert et al. | 252/103 |
| 4,359,413 | 11/1982 | Ward et al. | 252/527 |
| 4,587,031 | 5/1986 | Kruse et al. | 252/135 |
| 4,595,520 | 6/1986 | Heile et al. | 252/160 |
| 4,605,509 | 8/1986 | Corkill et al. | 252/131 |
| 4,677,130 | 6/1987 | Puzig | 514/389 |
| 4,680,134 | 7/1987 | Heile et al. | 252/160 |
| 4,695,284 | 9/1987 | Hight | 8/137 |
| 4,698,181 | 10/1987 | Lewis | 252/527 |
| 4,715,979 | 12/1987 | Moore et al. | 510/297 |
| 4,725,376 | 2/1988 | Copeland | 252/90 |
| 4,753,755 | 6/1988 | Gansser | 252/527 |
| 4,846,993 | 7/1989 | Lentsch et al. | 252/95 |
| 4,983,315 | 1/1991 | Glogowski et al. | 252/102 |
| 5,019,292 | 5/1991 | Baeck et al. | 252/174.25 |
| 5,034,147 | 7/1991 | Ramachandran | 252/95 |
| 5,061,392 | 10/1991 | Bruegge et al. | 252/135 |
| 5,078,301 | 1/1992 | Gladfelter et al. | 222/52 |
| 5,382,377 | 1/1995 | Raehse et al. | 264/142 |
| 5,419,850 | 5/1995 | Backes et al. | 252/174 |
| 5,516,449 | 5/1996 | Agar et al. | 510/301 |
| 5,559,089 | 9/1996 | Hartman et al. | 510/224 |
| 5,650,017 | 7/1997 | Gordon et al. | 134/7 |
| 5,665,694 | 9/1997 | Backes et al. | 510/480 |
| 5,763,378 | 6/1998 | Painter et al. | 510/224 |
| 5,858,299 | 1/1999 | Fernholz et al. | 264/414 |

FOREIGN PATENT DOCUMENTS

| | | |
|---|---|---|
| 0 364 840 | 4/1990 | European Pat. Off. . |
| 61-87800 | 5/1986 | Japan . |
| 687075 | 2/1953 | United Kingdom . |
| 92 02611 | 2/1992 | WIPO . |
| 95 18215 | 7/1995 | WIPO . |
| 96/08555 | 3/1996 | WIPO . |
| 9705226 | 2/1997 | WIPO . |

*Primary Examiner*—Lorna M. Douyon
*Attorney, Agent, or Firm*—Merchant & Gould P.C.

[57] ABSTRACT

The dimensionally stable alkaline solid block warewashing detergent uses an E-form binder forming a solid comprising a sodium carbonate source of alkalinity, a metal corrosion protecting alkali metal silicate composition, a sequestrant, a surfactant package and other optional material. The solid block is dimensionally stable and highly effective in removing soil from the surfaces of dishware in the institutional and industrial environment. The E-form hydrate comprises an organic phosphonate and a hydrated carbonate.

18 Claims, 1 Drawing Sheet

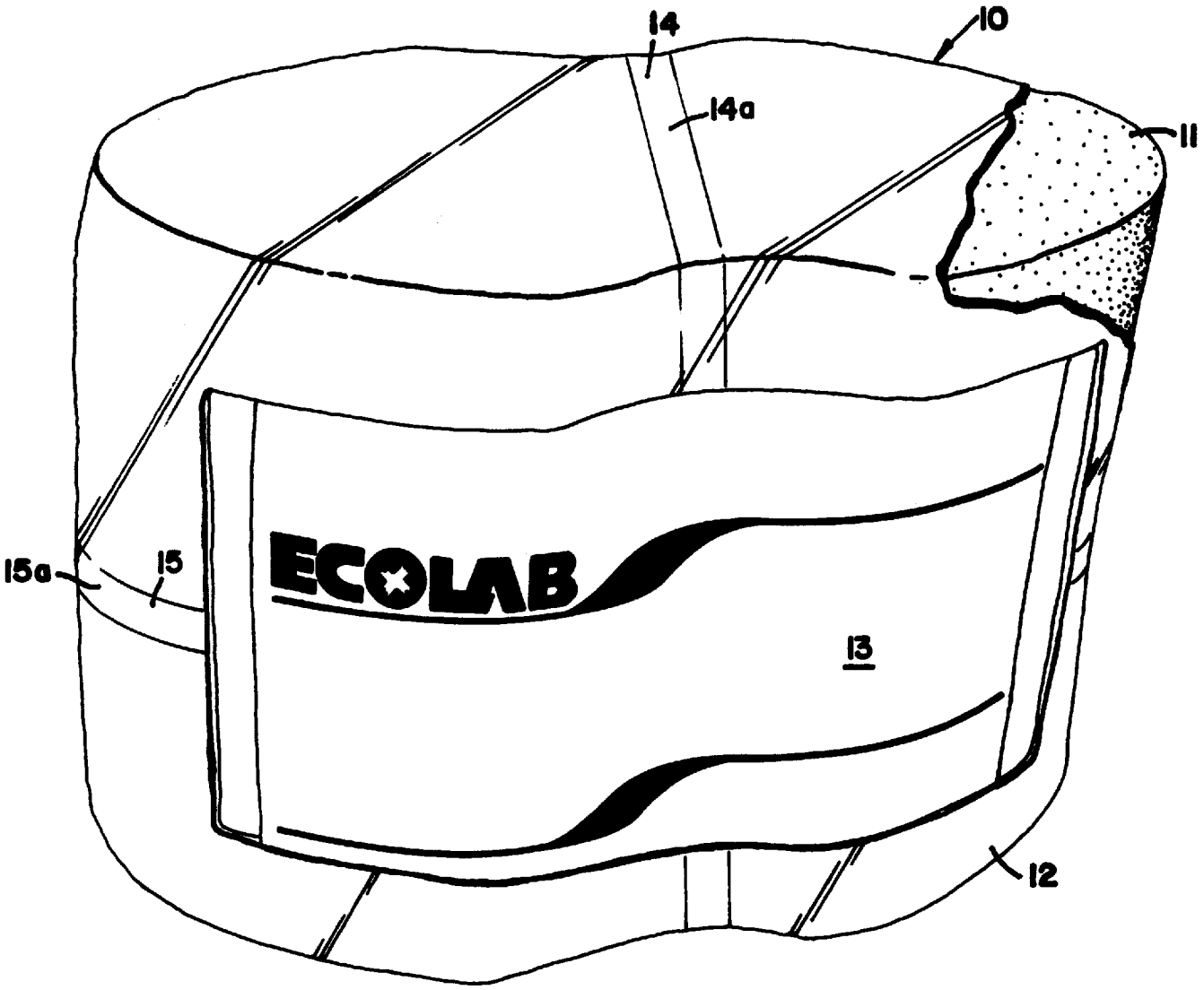
10
11
12
13
14
14a
15
15a
ECOLAB

STABLE SOLID BLOCK METAL PROTECTING WAREWASHING DETERGENT COMPOSITION

REFERENCE TO RELATED APPLICATIONS

This application is a continuation in part of Lentsch et al., U.S. Ser. No. 08/781,493, filed Jan. 13, 1997.

FIELD OF THE INVENTION

The invention relates to substantially inorganic mildly alkaline, anti-corrosion, metal-protecting warewashing detergent materials that can be manufactured in the form of a solid block and packaged for sale. In the manufacture of the solid detergent, a detergent mixture is extruded to form the solid. The solid water soluble or dispersible detergent is typically uniformly dispensed, without undershoot or overshoot of detergent concentration, from a spray-on type dispenser which creates an aqueous concentrate by spraying water onto the soluble solid product. The aqueous concentrate is directed to a use locus such as a warewashing machine to clean ware with no substantial corrosion of metal ware.

BACKGROUND OF THE INVENTION

The use of solid block detergents in institutional and industrial cleaning operations was pioneered in technology claimed in the Fernholz et al. U.S. Reissue Pat. Nos. 32,763 and 32,818. Further, pelletized materials are shown in Gladfelter et al., U.S. Pat. Nos. 5,078,301, 5,198,198 and 5,234,615. Extruded materials are disclosed in Gladfelter et al., U.S. Pat. No. 5,316,688. The solid block format is a safe, convenient and efficient product format. In the pioneering technology, substantial attention was focused on how the highly alkaline material, based on a substantial proportion of sodium hydroxide, was cast and solidified. Initial solid block products (and predecessor powder products) used a substantial proportion of a solidifying agent, sodium hydroxide hydrate, to solidify the cast material in a freezing process using the low melting point of sodium hydroxide monohydrate (about 50° C.–65° C.). The active components of the detergent were mixed with the molten sodium hydroxide and cooled to solidify. The resulting solid was a matrix of hydrated solid sodium hydroxide with the detergent ingredients dissolved or suspended in the hydrated matrix. In this prior art cast solid and other prior art hydrated solids, the hydrated chemicals are reacted with water and the hydration reaction is run to substantial completion. The sodium hydroxide also provided substantial cleaning in warewashing systems and in other use loci that require rapid and complete soil removal. In these early products sodium hydroxide was an ideal candidate because of the highly alkaline nature of the caustic material provided excellent cleaning. Another sodium hydroxide and sodium carbonate cast solid process using substantially hydrated sodium materials was disclosed in Heile et al. U.S. Pat. Nos. 4,595,520 and 4,680,134.

Similarly, pioneering technology relating to the use of solid pelleted alkaline detergent compositions in the form of a water soluble bag assembly and an extruded alkaline solid material wrapped in a water soluble film has also been pioneered by Ecolab Inc. These products within the water soluble bag can be directly inserted into a spray on dispenser wherein water dissolves the bag and contacts the soluble pellet or extruded solid, dissolves the effective detergent ingredients, creates an effective washing solution which is directed to a use locus.

In recent years, attention has been directed to producing a highly effective detergent material from less caustic materials such as soda ash, also known as sodium carbonate, because of manufacturing, processing, etc. advantages. Sodium carbonate is a mild base, and is substantially less strong (has a smaller $K_b$) than sodium hydroxide. Further on an equivalent molar basis, the pH of the sodium carbonate solution is one unit less than an equivalent solution of sodium hydroxide (an order of magnitude reduction in strength of alkalinity). Sodium carbonate formulations were not given serious consideration in the industry for use in heavy duty cleaning operations because of this difference in alkalinity. The industry believed carbonate could not adequately clean under the demanding conditions of time, soil load and type and temperature found in the institutional and industrial cleaning market. A few sodium carbonate based formulations have been manufactured and sold in areas where cleaning efficiency is not paramount. Further solid detergents made of substantially hydrated, the carbonate content contained at least about seven moles of water of hydration per mole of sodium carbonate were not dimensionally stable. The substantially hydrated block detergent tended to swell and crack upon aging. This swelling and cracking was attributed to changing of the sodium carbonate hydration states within the block. Lastly, molten hydrate processing can cause stability problems in manufacturing the materials. Certain materials at high melting temperatures in the presence of water can decompose or revert to less active or inactive materials. The carbonate detergents could under certain circumstances corrode metal surfaces. Ware made of active metals such as aluminum are subject to such corrosion when carbonates are used as the alkalinity source.

Accordingly, a substantial need for mechanically stable solid carbonate detergent products, having equivalent cleaning performance without substantial metal corrosion, when compared to caustic based detergents, has arisen. Further, a substantial need has arisen for successful non-molten processes for manufacturing sodium carbonate based detergents that form a solid with minimal amounts of water of hydration associated with the sodium base. These products and processes must combine ingredients and successfully produce a stable solid product that can be packaged, stored, distributed and used in a variety of use locations.

BRIEF DISCUSSION OF THE INVENTION

The invention involves a solid block detergent based on a combination of a carbonate hydrate and a non-hydrated carbonate species with a metal protecting anti-corrosion silicate component solidified by a novel hydrated species we call the E-form hydrate composition. The solid can contain other cleaning ingredients and a controlled amount of water. The solid carbonate/silicate based detergent is solidified by the E-form hydrate which acts as a binder material or binding agent dispersed throughout the solid. The E-form binding agent comprises at a minimum an organic phosphonate and water and can also have associated carbonate. The solid block detergent uses a substantial proportion, sufficient to obtain non-corrosive cleaning properties, of a hydrated carbonate, a non-hydrated carbonate and a silicate composition formed into solid in a novel structure using a novel E-form binder material in a novel manufacturing process. The solid integrity of the detergent, comprising carbonate, silicate and other cleaning compositions, is maintained by the presence of the E-form binding component comprising an organic phosphonate, substantially all water added to the detergent system and an associated fraction of the carbonate. In the detergent blocks of the invention, the use of a sodium silicate and a sodium carbonate with a potassium phosphonate have surprisingly been found to be a preferred composition for formation of a stable rapidly solidifying block. This E-form hydrate binding component is distributed throughout the solid and binds hydrated carbonate and non-hydrated carbonate and other detergent components into a stable solid block detergent.

The alkali metal carbonate is used in a formulation that additionally includes an effective amount of a metal protecting silicate and a hardness sequestering agent that both sequesters hardness ions such as calcium, magnesium and manganese but also provides soil removal and suspension properties. The formulations can also contain a surfactant system that, in combination with the sodium carbonate and other components, effectively removes soils at typical use temperatures and concentrations. The block detergent can also contain other common additives such as surfactants, builders, thickeners, soil anti-redeposition agents, enzymes, chlorine sources, oxidizing or reducing bleaches, defoamers, rinse aids, dyes, perfumes, etc.

Such block detergent materials are preferably substantially free of a component that can compete with the alkali metal carbonate or the E-form material for water of hydration and interfere with solidification. The most common interfering material comprises a second source of alkalinity. The detergent preferably contains less than a solidification interfering amount of the second alkaline source, and can contain less than 5 wt %, preferably less than 4 wt %, of common alkalinity sources including sodium hydroxide. While some small proportion sodium hydroxide can be present in the formulation to aid in performance, the presence of a substantial amount of sodium hydroxide can interfere with solidification. Sodium hydroxide preferentially binds water in these formulations and in effect prevents water from participating in the E-form hydrate binding agent and in solidification of the carbonate. On mole for mole basis, the solid detergent material contains greater than 5 moles of sodium carbonate for each total mole of both sodium hydroxide.

We have found that a highly effective detergent material can be made with little water (i.e. less than 11.5 wt %, preferably less than 10 wt % water) based on the block. The solid detergent compositions of Femholz et al. required depending on composition, a minimum of about 12–15 wt % of water of hydration for successful processing. The Fernholz solidification process requires water to permit the materials to fluid flow or melt flow sufficiently when processed or heated such that they can be poured into a mold such as a plastic bottle or capsule for solidification. At lesser amounts of water, the material would be too viscous to flow substantially for effective product manufacture. However, the carbonate based materials can be made in extrusion methods with little water. We have found that as the materials are extruded, the water of hydration tends to associate with the phosphonate component and, depending on conditions, a fraction of the anhydrous sodium carbonate used in the manufacture of the materials. If added water associates not with the E-form hydrate but improperly with other materials such as sodium hydroxide or sodium silicates, insufficient solidification occurs leaving a product resembling slush, paste or mush like a wet concrete. We have found that the total amount of water present in the solid block detergents of the invention is less than about 11 to 12 wt % water based on the total chemical composition (not including the weight of the container). The preferred solid detergent comprises about 0.1 to less than about 2.0, more preferably about 0.9 to 1.7 moles of water per each mole of carbonate. With this in mind for the purpose of this patent application, water of hydration recited in these claims relates primarily to water added to the composition that primarily hydrates and associates with the binder comprising a fraction of the sodium carbonate, the phosphonate and water of hydration. A chemical with water of hydration that is added into the process or products of this invention wherein the hydration remains associated with that chemical (does not dissociate from the chemical and associate with another) is not counted in this description of added water of hydration. Preferred hard dimensionally stable solid detergents will comprise about 5 to 20 wt %, preferably 10 to 15 wt % anhydrous carbonate. The balance of the carbonate comprises carbonate monohydrate. Further, some small amount of sodium carbonate monohydrate can be used in the manufacture of the detergent, however, such water of hydration is used in this calculation.

For the purpose of this application the term "solid block" includes extruded pellet materials having a weight of 10 grams, preferably 50 grams up through 250 grams, an extruded solid with a weight of about 100 grams or greater or a solid block detergent having a mass between about 1 and 10 kilograms.

BRIEF DESCRIPTION OF THE DRAWINGS

FIG. 1 is an isometric drawing of the wrapped solid detergent.

DETAILED DESCRIPTION OF THE INVENTION

The solid block detergents of the invention can comprise a source of alkalinity preferably an alkali metal carbonate, a metal protecting alkali metal silicate, an alkali metal salt of a sequestrant, preferably a potassium salt of an organo phosphonate and an E-form hydrate binding agent.

Active Ingredients

The present method is suitable for preparing a variety of solid cleaning compositions, as for example, extruded pellet, extruded block, etc., detergent compositions. The cleaning compositions of the invention comprise conventional alkaline carbonate cleaning agent, a metal protecting alkali metal silicate, a sequestering agent and other active ingredients that will vary according to the type of composition being manufactured. The essential ingredients are as follows:

Solid Matrix Composition

| Chemical | Percent Range |
|---|---|
| Alkali metal salt of an Organo-Phosphonate | 1–30 wt %; preferably 3–15 wt % of a potassium salt thereof |
| Water | 5–15 wt %; preferably 5–12 wt % |
| Alkali metal silicate | 12–25 wt %; preferably 15–30 wt % of a hydrated silicate (5 to 25% water) |
| Alkali Metal Carbonate | 25–80 wt %; preferably 30–55 wt % |
| Surfactant | 0 to 25 wt %; preferably 0.1–20 wt % |

As this material solidifies, a single E-form hydrate binder composition forms. This hydrate binder is not a simple hydrate of the carbonate component. We believe the solid detergent comprises a major proportion of carbonate monohydrate, a portion of non-hydrated (substantially anhydrous) alkali metal carbonate and the E-form binder composition comprising a fraction of the carbonate material, an amount of the organophosphonate and water of hydration. The alkaline detergent composition can include an amount of a source of alkalinity, preferably an alkali metal silicate metal protecting agent, that does not interfere with solidification and minor but effective amounts of other ingredients such as surfactant(s), a chelating agent/sequestrant including a phosphonate, polyphosphate, a bleaching agent such as an encapsulated bleach, sodium hypochlorite or hydrogen peroxide, an enzyme such as a lipase, a protease or an amylase, and the like.

Alkaline Sources

The cleaning composition produced according to the invention may include effective amounts of one or more alkaline sources to enhance cleaning of a substrate and improve soil removal performance of the composition. The alkaline matrix is bound into a solid due to the presence of the binder hydrate composition including its water of hydration. The composition comprises about 10–80 wt %, preferably about 15–70 wt % of an alkali metal carbonate source, most preferably about 20–60 wt %. The total alkalinity source can comprise about 5 wt % or less of an alkali metal hydroxide. A metal carbonate such as sodium or potassium carbonate, bicarbonate, sesquicarbonate, mixtures thereof and the like can be used. Suitable alkali metal hydroxides include, for example, sodium or potassium hydroxide. An alkali metal hydroxide may be added to the composition in the form of solid beads, dissolved in an aqueous solution, or a combination thereof. Alkali metal hydroxides are commercially available as a solid in the form of prilled solids or beads having a mix of particle sizes ranging from about 12–100 U.S. mesh, or as an aqueous solution, as for example, as a 50 wt % and a 73 wt % solution.

Metal Protecting Silicates

We have found that an effective amount of an alkaline metal silicate or hydrate thereof can be employed in the compositions and processes of the invention to form a stable solid warewashing detergent that can have metal protecting capacity. The silicates employed in the compositions of the invention are those that have conventionally been used in warewashing formulations. For example, typical alkali metal silicates are those powdered, particulate or granular silicates which are either anhydrous or preferably which contain water of hydration (5 to 25 wt %, preferably 15 to 20 wt % water of hydration). These silicates are preferably sodium silicates and have a $Na_2O:SiO_2$ ratio of about 1:1 to about 1:5, respectively, and typically contain available bound water in the amount of from 5 to about 25 wt %. In general, the silicates of the present invention have a $Na_2O:SiO_2$ ratio of 1:1 to about 1:3.75, preferably about 1:1.5 to about 1:3.75 and most preferably about 1:1.5 to about 1:2.5. A silicate with a $Na_2O:SiO_2$ ratio of about 1:2 and about 16 to 22 wt % water of hydration, is most preferred. For example, such silicates are available in powder form as GD Silicate and in granular form as Britesil H-20, from PQ Corporation. These ratios may be obtained with single silicate compositions or combinations of silicates which upon combination result in the preferred ratio. The hydrated silicates at preferred ratios, a $Na_2O:SiO_2$ ratio of about 1:1.5 to about 1:2.5 have been found to provide the optimum metal protection and rapidly forming solid block detergent. The amount of silicate used in forming the compositions of the invention tend to vary between 10 and 30 wt %, preferably about 15 to 30 wt % depending on degree of hydration. Hydrated silicates are preferred.

Cleaning Agents

The composition can comprise at least one cleaning agent which is preferably a surfactant or surfactant system. A variety of surfactants can be used in a cleaning composition, including anionic, nonionic, cationic, and zwitterionic surfactants, which are commercially available from a number of sources. Anionic and nonionic agents are preferred. For a discussion of surfactants, see Kirk-Othmer, *Encyclopedia of Chemical Technology,* Third Edition, volume 8, pages 900–912. Preferably, the cleaning composition comprises a cleaning agent in an amount effective to provide a desired level of cleaning, preferably about 0–20 wt %, more preferably about 1.5–15 wt %.

Anionic surfactants useful in the present cleaning compositions, include, for example, carboxylates such as alkylcarboxylates (carboxylic acid salts) and polyalkoxycarboxylates, alcohol ethoxylate carboxylates, nonylphenol ethoxylate carboxylates, and the like; sulfonates such as alkylsulfonates, alkylbenzenesulfonates, alkylarylsulfonates, sulfonated fatty acid esters, and the like; sulfates such as sulfated alcohols, sulfated alcohol ethoxylates, sulfated alkylphenols, alkylsulfates, sulfosuccinates, alkylether sulfates, and the like; and phosphate esters such as alkylphosphate esters, and the like. Preferred anionics are sodium alkylarylsulfonate, alpha-olefinsulfonate, and fatty alcohol sulfates.

Nonionic surfactants useful in cleaning compositions, include those having a polyalkylene oxide polymer as a portion of the surfactant molecule. Such nonionic surfactants include, for example, chlorine-, benzyl-, methyl-, ethyl-, propyl-, butyl- and other like alkyl-capped polyethylene glycol ethers of fatty alcohols; polyalkylene oxide free nonionics such as alkyl polyglycosides; sorbitan and sucrose esters and their ethoxylates; alkoxylated ethylene diamine; alcohol alkoxylates such as alcohol ethoxylate propoxylates, alcohol propoxylates, alcohol propoxylate ethoxylate propoxylates, alcohol ethoxylate butoxylates, and the like; nonylphenol ethoxylate, polyoxyethylene glycol ethers and the like; carboxylic acid esters such as glycerol esters, polyoxyethylene esters, ethoxylated and glycol esters of fatty acids, and the like; carboxylic amides such as diethanolamine condensates, monoalkanolamine condensates, polyoxyethylene fatty acid amides, and the like; and polyalkylene oxide block copolymers including an ethylene oxide/propylene oxide block copolymer such as those commercially available under the trademark PLURONIC® (BASF-Wyandotte), and the like; and other like nonionic compounds. Silicone surfactants such as the ABIL® B8852 can also be used.

Cationic surfactants useful for inclusion in a cleaning composition for sanitizing or fabric softening, include amines such as primary, secondary and tertiary monoamines with $C_{18}$ alkyl or alkenyl chains, ethoxylated alkylamines, alkoxylates of ethylenediamine, imidazoles such as a 1-(2-hydroxyethyl)-2-imidazoline, a 2-alkyl-1-(2-hydroxyethyl)-2-imidazoline, and the like; and quaternary ammonium salts, as for example, alkylquaternary ammonium chloride surfactants such as n-alkyl($C_{12}$–$C_{18}$)dimethylbenzyl ammonium chloride, n-tetradecyldimethylbenzylammonium chloride monohydrate, a naphthylene-substituted quaternary ammonium chloride such as dimethyl-1-naphthylmethylammonium chloride, and the like; and other like cationic surfactants.

Other Additives

Solid cleaning compositions made according to the invention may further include conventional additives such as a chelating/sequestering agent, bleaching agent, alkaline source, secondary hardening agent or solubility modifier, detergent filler, defoamer, anti-redeposition agent, a threshold agent or system, aesthetic enhancing agent (i.e., dye, perfume), and the like. Adjuvants and other additive ingredients will vary according to the type of composition being manufactured. The composition may include a chelating/sequestering agent such as an aminocarboxylic acid, a condensed phosphate, a phosphonate, a polyacrylate, and the like. In general, a chelating agent is a molecule capable of coordinating (i.e., binding) the metal ions commonly found in natural water to prevent the metal ions from interfering with the action of the other detersive ingredients of a cleaning composition. The chelating/sequestering agent may also function as a threshold agent when included in an effective amount. Preferably, a cleaning composition includes about 0.1–70 wt %, preferably from about 5–60 wt %, of a chelating/sequestering agent.

Useful aminocarboxylic acids include, for example, N-hydroxyethyliminodiacetic acid, nitrilotriacetic acid (NTA), ethylenediaminetetraacetic acid (EDTA), N-hydroxyethyl-ethylenediaminetriacetic acid (HEDTA), diethylenetriaminepentaacetic acid (DTPA), and the like.

Examples of condensed phosphates useful in the present composition include sodium and potassium orthophosphate, sodium and potassium pyrophosphate, sodium tripolyphosphate, sodium hexametaphosphate, and the like. A condensed phosphate may also assist, to a limited extent, in solidification of the composition by fixing the free water present in the composition as water of hydration.

The composition may include a phosphonate such as 1-hydroxyethane-1,1-diphosphonic acid $CH_3C(OH)[PO(OH)_2]_2$(HEDP); amino tri(methylenephosphonic acid) $N[CH_2PO(OH)_2]_3$; aminotri(methylenephosphonate), sodium salt

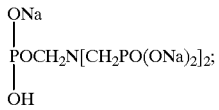

$$\begin{array}{l} ONa \\ | \\ POCH_2N[CH_2PO(ONa)_2]_2; \\ | \\ OH \end{array}$$

2-hydroxyethyliminobis(methylenephosphonic acid) $HOCH_2CH_2N[CH_2PO(OH)_2]_2$; diethylenetriaminepenta (methylenephosphonic acid) $(HO)_2POCH_2N[CH_2CH_2N[CH_2PO(OH)_2]_2]_2$; diethylenetriaminepenta (methylenephosphonate), sodium salt $C_9H_{(28-x)}N_3Na_xO_{15}P_5$ (x=7); hexamethylenediamine(tetramethylenephosphonate), potassium salt $C_{10}H_{(28-x)}N_2K_xO_{12}P_4$ (x=6); bis (hexamethylene)triamine(pentamethylenephosphonic acid) $(HO_2)POCH_2N[(CH_2)_6N[CH_2PO(OH)_2]_2]_2$; and phosphorus acid $H_3PO_3$.

Preferred phosphonates are HEDP, ATMP and DTPMP. A neutralized or alkaline phosphonate, or a combination of the phosphonate with an alkali source prior to being added into the mixture such that there is little or no heat or gas generated by a neutralization reaction when the phosphonate is added is preferred. The most preferred phosphonate comprises a potassium salt of an organo phosphonic acid (a potassium phosphonate). One preferred mode for forming the potassium salt of the phosphonic acid material involves neutralizing the phosphonic acid with an aqueous potassium hydroxide solution during the manufacture of the solid block detergent. In a preferred mode, the phosphonic acid sequestering agent can be combined with a potassium hydroxide solution at appropriate proportions to provide a stoichiometric amount of potassium hydroxide to neutralize the phosphonic acid. A potassium hydroxide having a concentration of from about 1 to about 50 wt % can be used. The phosphonic acid can be dissolved or suspended in an aqueous medium and the potassium hydroxide can then be added to the phosphonic acid for neutralization purposes.

Polymeric polycarboxylates suitable for use as cleaning agents have pendant carboxylate ($—CO_2^-$) groups and include, for example, polyacrylic acid, maleic/olefin copolymer, acrylic/maleic copolymer, polymethacrylic acid, acrylic acid-methacrylic acid copolymers, hydrolyzed polyacrylamide, hydrolyzed polymethacrylamide, hydrolyzed polyamide-methacrylamide copolymers, hydrolyzed polyacrylonitrile, hydrolyzed polymethacrylonitrile, hydrolyzed acrylonitrile-methacrylonitrile copolymers, and the like. For a further discussion of chelating agents/sequestrants, see Kirk-Othmer, *Encyclopedia of Chemical Technology,* Third Edition, volume 5, pages 339–366 and volume 23, pages 319–320, the disclosure of which is incorporated by reference herein.

Bleaching agents for use in a cleaning compositions for lightening or whitening a substrate, include bleaching compounds capable of liberating an active halogen species, such as $Cl_2$, $Br_2$, $—OCl^-$ and/or $—OBr^-$, under conditions typically encountered during the cleansing process. Suitable bleaching agents for use in the present cleaning compositions include, for example, chlorine-containing compounds such as a chlorine, a hypochlorite, chloramine. Preferred halogen-releasing compounds include the alkali metal dichloroisocyanurates, chlorinated trisodium phosphate, the alkali metal hypochlorites, monochloramine and dichloramine, and the like. Encapsulated chlorine sources may also be used to enhance the stability of the chlorine source in the composition (see, for example, U.S. Pat. Nos. 4,618,914 and 4,830,773, the disclosure of which is incorporated by reference herein). A bleaching agent may also be a peroxygen or active oxygen source such as hydrogen peroxide, perborates, sodium carbonate peroxyhydrate, phosphate peroxyhydrates, potassium permonosulfate, and sodium perborate mono and tetrahydrate, with and without activators such as tetraacetylethylene diamine, and the like. A cleaning composition may include a minor but effective amount of a bleaching agent, preferably about 0.1–10 wt %, preferably about 1–6 wt %.

Detergent Builders or Fillers

A cleaning composition may include a minor but effective amount of one or more of a detergent filler which does not perform as a cleaning agent per se, but cooperates with the cleaning agent to enhance the overall cleaning capacity of the composition. Examples of fillers suitable for use in the present cleaning compositions include sodium sulfate, sodium chloride, starch, sugars, $C_1$–$C_{10}$ alkylene glycols such as propylene glycol, and the like. Preferably, a detergent filler is included in an amount of about 1–20 wt %, preferably about 3–15 wt %.

Defoaming Agents

A minor but effective amount of a defoaming agent for reducing the stability of foam may also be included in the present cleaning compositions. Preferably, the cleaning composition includes about 0.0001–5 wt % of a defoaming agent, preferably about 0.01–3 wt %.

Examples of defoaming agents suitable for use in the present compositions include silicone compounds such as silica dispersed in polydimethylsiloxane, fatty amides, hydrocarbon waxes, fatty acids, fatty esters, fatty alcohols, fatty acid soaps, ethoxylates, mineral oils, polyethylene glycol esters, alkyl phosphate esters such as monostearyl phosphate, and the like. A discussion of defoaming agents may be found, for example, in U.S. Pat. No. 3,048,548 to Martin et al., U.S. Pat. No. 3,334,147 to Brunelle et al., and U.S. Pat. No. 3,442,242 to Rue et al., the disclosures of which are incorporated by reference herein.

Anti-Redeposition Agents

A cleaning composition may also include an anti-redeposition agent capable of facilitating sustained suspension of soils in a cleaning solution and preventing the removed soils from being redeposited onto the substrate being cleaned. Examples of suitable anti-redeposition agents include fatty acid amides, fluorocarbon surfactants, complex phosphate esters, styrene maleic anhydride copolymers, and cellulosic derivatives such as hydroxyethyl cellulose, hydroxypropyl cellulose, and the like. A cleaning composition may include about 0.5–10 wt %, preferably about 1–5 wt %, of an anti-redeposition agent.

Dyes/Odorants

Various dyes, odorants including perfumes, and other aesthetic enhancing agents may also be included in the composition. Dyes may be included to alter the appearance of the composition, as for example, Direct Blue 86 (Miles), Fastusol Blue (Mobay Chemical Corp.), Acid Orange 7 (American Cyanamid), Basic Violet 10 (Sandoz), Acid Yellow 23 (GAF), Acid Yellow 17 (Sigma Chemical), Sap Green (Keyston Analine and Chemical), Metanil Yellow (Keystone Analine and Chemical), Acid Blue 9 (Hilton Davis), Sandolan Blue/Acid Blue 182 (Sandoz), Hisol Fast Red (Capitol Color and Chemical), Fluorescein (Capitol Color and Chemical), Acid Green 25 (Ciba-Geigy), and the like.

Fragrances or perfumes that may be included in the compositions include, for example, terpenoids such as citronellol, aldehydes such as amyl cinnamaldehyde, a jasmine such as C1 S-jasmine or jasmal, vanillin, and the like.

Aqueous Medium

The ingredients may optionally be processed in a minor but effective amount of an aqueous medium such as water to achieve a homogenous mixture, to aid in the solidification, to provide an effective level of viscosity for processing the mixture, and to provide the processed composition with the desired amount of firmness and cohesion during discharge and upon hardening. The mixture during processing typically comprises about 0.2–12 wt % of an aqueous medium, preferably about 0.5–10 wt %.

Processing of the Composition

The invention provides a method of processing a solid cleaning composition. According to the invention, a cleaning agent and optional other ingredients are mixed with an effective solidifying amount of ingredients in an aqueous medium. A minimal amount of heat may be applied from an external source to facilitate processing of the mixture.

A mixing system provides for continuous mixing of the ingredients at high shear to form a substantially homogeneous liquid or semi-solid mixture in which the ingredients are distributed throughout its mass. Preferably, the mixing system includes means for mixing the ingredients to provide shear effective for maintaining the mixture at a flowable consistency, with a viscosity during processing of about 1,000–1,000,000 cP, preferably about 50,000–200,000 cP. The mixing system is preferably a continuous flow mixer or more preferably, a single or twin screw extruder apparatus, with a twin-screw extruder being highly preferred.

The mixture is typically processed at a temperature to maintain the physical and chemical stability of the ingredients, preferably at ambient temperatures of about 20–80° C., more preferably about 25–55° C. Although limited external heat may be applied to the mixture, the temperature achieved by the mixture may become elevated during processing due to friction, variances in ambient conditions, and/or by an exothermic reaction between ingredients. Optionally, the temperature of the mixture may be increased, for example, at the inlets or outlets of the mixing system.

An ingredient may be in the form of a liquid or a solid such as a dry particulate, and may be added to the mixture separately or as part of a premix with another ingredient, as for example, the cleaning agent, the aqueous medium, and additional ingredients such as a second cleaning agent, a detergent adjuvant or other additive, a secondary hardening agent, and the like. One or more premixes may be added to the mixture.

The ingredients are mixed to form a substantially homogeneous consistency wherein the ingredients are distributed substantially evenly throughout the mass. The mixture is then discharged from the mixing system through a die or other shaping means. The profiled extrudate then can be divided into useful sizes with a controlled mass. Preferably, the extruded solid is packaged in film. The temperature of the mixture when discharged from the mixing system is preferably sufficiently low to enable the mixture to be cast or extruded directly into a packaging system without first cooling the mixture. The time between extrusion discharge and packaging may be adjusted to allow the hardening of the detergent block for better handling during further processing and packaging. Preferably, the mixture at the point of discharge is about 20–90° C., preferably about 25–55° C. The composition is then allowed to harden to a solid form that may range from a low density, sponge-like, malleable, caulky consistency to a high density, fused solid, concrete-like block.

Optionally, heating and cooling devices may be mounted adjacent to mixing apparatus to apply or remove heat in order to obtain a desired temperature profile in the mixer. For example, an external source of heat may be applied to one or more barrel sections of the mixer, such as the ingredient inlet section, the final outlet section, and the like, to increase fluidity of the mixture during processing. Preferably, the temperature of the mixture during processing, including at the discharge port, is maintained preferably at about 20–90° C.

When processing of the ingredients is completed, the mixture may be discharged from the mixer through a discharge die. The composition eventually hardens due to the chemical reaction of the ingredients forming the E-form hydrate binder. The solidification process may last from a few minutes to about six hours, depending, for example, on the size of the cast or extruded composition, the ingredients of the composition, the temperature of the composition, and other like factors. Preferably, the cast or extruded composition "sets up" or begins to hardens to a solid form within about 1 minute to about 3 hours, preferably about 1 minute to about 2 hours, preferably about 1 minute to about 20 minutes.

Packaging System

The packaging receptacle or container may be rigid or flexible, and composed of any material suitable for containing the compositions produced according to the invention, as for example glass, metal, plastic film or sheet, cardboard, cardboard composites, paper, and the like. Advantageously, since the composition is processed at or near ambient temperatures, the temperature of the processed mixture is low enough so that the mixture may be cast or extruded directly into the container or other packaging system without structurally damaging the material. As a result, a wider variety of materials may be used to manufacture the container than those used for compositions that processed and dispensed under molten conditions. Preferred packaging used to contain the compositions is manufactured from a flexible, easy opening film material.

Dispensing of the Processed Compositions

The cleaning composition made according to the present invention is dispensed from a spray-type dispenser such as that disclosed in U.S. Pat. Nos. 4,826,661, 4,690,305, 4,687,121, 4,426,362 and in U.S. Pat. Nos. Re 32,763 and 32,818, the disclosures of which are incorporated by reference herein. Briefly, a spray-type dispenser functions by impinging a water spray upon an exposed surface of the solid composition to dissolve a portion of the composition, and then immediately directing the concentrate solution comprising the composition out of the dispenser to a storage reservoir or directly to a point of use. The concentration of the detergent in the aqueous alkaline detergent comprises about 100 parts of detergent to about 2500 parts of detergent per each one million parts by weight of the aqueous detergent. The preferred product shape is shown in FIG. 11. When used, the product is removed from the package (e.g.) film and is inserted into the dispenser. The spray of water can be made by a nozzle in a shape that conforms to the solid detergent shape. The dispenser enclosure can also closely fit the detergent shape in a dispensing system that prevents the introduction and dispensing of an incorrect detergent.

DETAILED DISCUSSION OF THE DRAWINGS

FIG. 1 is a drawing of a preferred embodiment of the packaged solid block detergent of the invention. The detergent has a unique pinch waist elliptical profile. This profile ensures that this block with its particular profile can fit only spray on dispensers that have a correspondingly shaped location for the solid block detergent. We are unaware of any solid block detergent having this shape in the market place. The shape of the solid block ensures that no unsuitable substitute for this material can easily be placed into the dispenser for use in a warewashing machine. In FIG. 1 the overall product 10 is shown having a cast solid block 11 (revealed by the removal of packaging 12). The packaging includes a label 13. The film wrapping can easily be removed using a tear line 15 or 15*a* or fracture line 14 or 14*a* incorporated in the wrapping.

The above specification provides a basis for understanding the broad meets and bounds of the invention. The following examples and test data provide an understanding of certain specific embodiments of the invention and contain a best mode. The invention will be further described by reference to the following detailed examples. These examples are not meant to limit the scope of the invention that has been set forth in the foregoing description. Variation within the concepts of the invention are apparent to those skilled in the art.

EXAMPLE 1

A solid block detergent composition was formed using the following compositions:

| COMPOSITION | WT % |
|---|---|
| Soft Water | 2.9 |
| Nonionic Surfactant | 2.5 |
| NaOH (50% Active) | 2.9 |
| Nonionic defoamer | 0.2 |
| ATMP (Briquest 301 Low AM) | 3.8 |
| Powder Premix | 31.8 |
| $Na_2CO_3$ (Dense Ash) | 38.3 |
| GD Silicate | 17.5 |

In a mixing tank the soft water, the NaOH neutralizer and the ATMP (aminotri(methylene-phosphonic acid)) were mixed and warmed to a temperature of about 115° F. A Teledyne paste processor, equipped with all screw sections and liquid and powder feed ports, was operated to make the solid detergent composition. In separate addition feed ports the dense ash, the powder premix, the GD silicate, the aqueous solution of the sequestrant and the nonionic surfactants were separately metered into the paste processor. The extrusion was accomplished at a temperature of about 120° F. The materials extruded from the extruder as a soft mass but solidified into a hard block detergent in less than 30 minutes which was wrapped in a plastic wrap.

EXAMPLE 2

Spot and Film Cleaning Performance Test

10 Cycle Spot, Film, Starch Spec Test/Protein and Lipstick Removal

Purpose

To evaluate Cleaning Performance of Metal Protecting detergent with 17.5% GD Silicate

| Conditions of Test | Composition of Food |
|---|---|
| 1000 ppm Detergent Concentration | 33.33% Beef Stew Soil |
| 2000 ppm Food Soil | 33.33% Hot Point Soil |
| No Rinse Aid | 33.33% Potato Buds |
| Hobart C-44 Dish Machine | |
| City Water (5.5 grain) | |
| 3 Redeposition Glasses | |
| 5 Glasses dipped in whole milk and dried 8 min. in a humidity chamber (100° F./65% RH) | |

The following formula which can be solidified using the procedure of Example 1, in an Ash Based Solid Formula, was used in the test by adding the components separately to the machine.

| Raw Materials | Percent | Initial Cycle (grams) | Per 1 Cycle (grams) |
|---|---|---|---|
| Water | 3.8 | 5.0 | 0.3 |
| Aminotri(methylene-phosphonic acid) (Briquest 301 Low AM) | 5.8 | 7.5 | 0.4 |
| NaOH, 50% | 4.5 | 5.8 | 0.3 |
| PowderPremix[1] | 31.8 | 41.1 | 2.2 |
| Nonionic surfactant | 2.5 | 3.2 | 0.2 |
| Nonionic Defoamer | 0.2 | 0.3 | 0.01 |
| Dense Ash ($CaCO_3$) | 33.8 | 43.6 | 2.4 |
| GD Silicate 18% water ($Na_2O$:$SiO_2$-1:2) | 17.5 | 22.6 | 1.2 |
| TOTAL | 100.0000 | | |
| Beef Stew Soil/Hot Point | | 172 | 9 |
| Soil Combined | | 86 | 4.6 |
| Potato Buds | | | |

Test Conditions:

City Water (~4–5 grains hardness); 2000 ppm 3 Food Soil; Hobart C-44; 10 cycles Redep. = 3 redeposition glasses
Coated = 5 glasses dipped in whole milk and dried 8 mins. in humidity chamber 100° F./65% RH)

[1]POWDER PREMIX

| Ingredients | Wt % |
|---|---|
| Granular Sodium Tripolyphosphate | 94.2 |
| Nonionic | 3.6 |
| Stearic monoethanolamide | 0.6 |
| Silicone Surfactant | 1.6 |

TABLE 1

| Detergent and Silicate | | | | | | | | |
|---|---|---|---|---|---|---|---|---|
| Detergent | Glass | Spots | Film | Starch | Lipstick Cycle 2–10 | Lipstick Cycle 1 | Protein | Comments |
| Metal Fusion | Coated | 3 | 1 | 2 | — | — | 3 | No Foam |
| 1000 ppm | Redep. | 1.75 | 1 | 1.75 | 1 | 1 | — | Coated Redep. - spots |
| (the above with silicate) | | | | | | | | No lipstick traces |

TABLE 2

| No Silicate | | | | | | | | |
|---|---|---|---|---|---|---|---|---|
| Detergent | Glass | Spots | Film | Starch | Lipstick Cycle 2–10 | Lipstick Cycle 1 | Protein | Comments |
| Solid Fusion | Coated | 3.5 | 1 | 1.75 | — | — | 3 | No Foam |
| 1000 ppm | Redep. | 2 | 1 | 1.5 | 1 | 1.5 | — | Coated spots, Redep. - streaks |
| (comparable formula without silicate) | | | | | | | | Small trace of lipstick 1st cycle only |

Tables 1 and 2 demonstrate the excellent cleaning properties of the detergents of the invention.

In the following Tables 3–6, solid block detergents having formulas similar to that in Example 2, except for the noted amounts of silicate, were tested for corrosion properties. In the following tables, the aluminum coupons are first washed with a detergent carefully with a soft sponge. The coupons are then dried in toluene and placed in a desiccator for equilibration. The equilibrated coupons are placed in a glass bottle with solutions of detergent to be tested and are then placed in a water bath at 54.5° C. (130° F.) for 8 hours. After the treatment is finished, the coupons are rinsed with deionized water, soaked in nitric acid for 3 minutes and again rinsed with deionized water. The coupons are then weighed for milligram weight loss and inspected for final appearance. The following Tables 3–6 demonstrate the anticorrosive ability of the carbonate silicate detergents of the invention and show the surprising anticorrosive nature when compared to caustic based detergents.

TABLE 3

METAL CORROSION - ALUMINUM NON-CLAD COUPONS
A corrosion rate in excess of 250 MPY indicates the product is considered corrosive to that specific metal

| % SOLUTION | WT. LOSS (mg) | CORROSION RATE mils/yr | AVG C. RATE mils/yr | FINAL APPEARANCE |
|---|---|---|---|---|
| Control (D.I. water) | | | | |
| 1 | 2.1 | 13.6920 | 13.2573 | Dull Gray |
| 2 | 2 | 13.0400 | | Dull Gray |
| 3 | 2 | 13.0400 | | Dull Gray |
| 650 ppm Detergent, 17.5% GD Silicate | | | | |
| 4 | 20.8 | 135.6160 | 135.3987 | Brown/Gray |
| 5 | 20.8 | 135.6160 | | Brown/Gray |
| 6 | 20.7 | 134.9640 | | Brown/Gray |
| 750 ppm Detergent, 17.5% GD Silicate | | | | |
| 7 | 22.8 | 148.6560 | 55.8547 | Brown/Gray |
| 8 | 1.3 | 8.4760 | | Shiny Gray |
| 9 | 1.6 | 10.4320 | | Shiny Gray |
| 850 ppm Detergent, 17.5% GD Silicate | | | | |
| 10 | 1 | 6.5200 | 5.433 | Shiny Gray |
| 11 | 0.6 | 3.9120 | | Shiny Gray |
| 12 | 0.9 | 5.8680 | | Shiny Gray |

TABLE 3-continued

METAL CORROSION - ALUMINUM NON-CLAD COUPONS
A corrosion rate in excess of 250 MPY indicates the product is considered corrosive to that specific metal

| % SOLUTION | WT. LOSS (mg) | CORROSION RATE mils/yr | AVG C. RATE mils/yr | FINAL APPEARANCE |
|---|---|---|---|---|
| 1125 ppm Detergent, 17.5% GD Silicate | | | | |
| 13 | 0.9 | 5.8680 | 5.4333 | Shiny Gray |
| 14 | 0.5 | 3.2600 | | Shiny Gray |
| 15 | 1.1 | 7.1720 | | Shiny Gray |

TABLE 4

| % SOLUTION | WT. LOSS (mg) | CORROSION RATE mils/yr | AVG C. RATE mils/yr | FINAL APPEARANCE |
|---|---|---|---|---|
| Control (D.I. water) | | | | |
| 1 | 2.3 | 14.9960 | 15.8653 | Dull Gray |
| 2 | 2 | 13.0400 | | Dull Gray |
| 3 | 3 | 19.5600 | | Dull Gray |
| 2000 ppm Detergent, 5% GD Silicate | | | | |
| 4 | 46.4 | 302.5280 | 305.1360 | Gray/Brown |
| 5 | 47.4 | 309.0480 | | Gray/Brown |
| 6 | 46.6 | 303.8320 | | Gray/Brown |
| 2000 ppm Detergent, 10% GD Silicate | | | | |
| 7 | 0.6 | 3.9120 | 2.8253 | Shiny Gray |
| 8 | 0.4 | 2.6080 | | Shiny Gray |
| 9 | 0.3 | 1.9560 | | Shiny Gray |
| 600 ppm Detergent, 15% GD Silicate | | | | |
| 10 | 19.8 | 129.0960 | 132.1387 | Brown/Gray |
| 11 | 20.4 | 133.0080 | | Brown/Gray |
| 12 | 20.6 | 134.3120 | | Brown/Gray |
| 600 ppm Detergent, 20% GD Silicate | | | | |
| 13 | 1.3 | 8.4760 | 7.8240 | Shiny Gray |
| 14 | 1.2 | 7.8240 | | Shiny Gray |
| 15 | 1.1 | 7.1720 | | Shiny Gray |
| 600 ppm Detergent, 25% GD Silicate | | | | |
| 16 | 0.4 | 2.6080 | 3.9120 | Shiny Gray |
| 17 | 0.7 | 4.5640 | | Shiny Gray |
| 18 | 0.7 | 4.5640 | | Shiny Gray |
| 600 ppm Detergent, 30% GD Silicate | | | | |
| 19 | 0.4 | 2.6080 | 2.6080 | Shiny Gray |
| 20 | 0.5 | 3.2600 | | Shiny Gray |
| 21 | 0.3 | 1.9560 | | Shiny Gray |

TABLE 5

| % SOLUTION | WT. LOSS (mg) | CORROSION RATE mils/yr | AVG C. RATE mils/yr | FINAL APPEARANCE |
|---|---|---|---|---|
| Control (D.I. water) | | | | |
| 1 | 3.2 | 20.8640 | 18.2560 | Dull Gray |
| 2 | 3.2 | 20.8640 | | Dull Gray |
| 3 | 2 | 13.0400 | | Dull Gray |
| 750 ppm Detergent, 7.5% GD Silicate | | | | |
| 4 | 22.4 | 146.0480 | 150.3947 | Brown/Gray |

TABLE 5-continued

| % SOLUTION | WT. LOSS (mg) | CORROSION RATE mils/yr | AVG C. RATE mils/yr | FINAL APPEARANCE |
|---|---|---|---|---|
| 5 | 22.9 | 149.3080 | | Brown/Gray |
| 6 | 23.9 | 155.8280 | | Brown/Gray |
| 750 ppm Detergent, 12.5% GD Silicate | | | | |
| 16 | 22.3 | 145.3960 | 149.0907 | Brown/Gray |
| 17 | 22.9 | 149.3080 | | Brown/Gray |
| 18 | 23.4 | 152.5680 | | Brown/Gray |
| 1125 ppm Detergent, 12.5% GD Silicate | | | | |
| 19 | 1.3 | 8.4760 | 6.7373 | Shiny Gray |
| 20 | 0.7 | 4.5640 | | Shiny Gray |
| 21 | 1.1 | 7.1720 | | Shiny Gray |
| 750 ppm Detergent, 15% GD Silicate | | | | |
| 22 | 23.0 | 149.9600 | 149.9600 | Yellow/Brown |
| 23 | 22.7 | 148.0040 | | Yellow/Brown |
| 24 | 23.3 | 151.9160 | | Yellow/Brown |
| 1125 ppm Detergent, 15% GD Silicate | | | | |
| 25 | 0.6 | 3.9120 | 3.9120 | Shiny Gray |
| 26 | 0.6 | 3.9120 | | Shiny Gray |
| 27 | 0.6 | 3.9120 | | Shiny Gray |
| 750 ppm Detergent, 17.5% GD Silicate | | | | |
| 28 | 1.1 | 7.1720 | 6.9547 | Shiny Gray |
| 29 | 1 | 6.5200 | | Shiny Gray |
| 30 | 1.1 | 7.1720 | | Shiny Gray |
| 1125 ppm Detergent, 17.5% GD Silicate | | | | |
| 31 | 0.5 | 3.2600 | 3.0427 | Shiny Gray |
| 32 | 0.5 | 3.2600 | | Shiny Gray |
| 33 | 0.4 | 2.6080 | | Shiny Gray |

TABLE 6

METAL CORROSION - ALUMINUM NON-CLAD COUPONS

| % SOLUTION | WT. LOSS (mg) | CORROSION RATE mils/yr | AVG C. RATE mils/yr | FINAL APPEARANCE |
|---|---|---|---|---|
| Control (D.I. water) | | | | |
| 1 | 2.6 | 16.9520 | 9.7800 | Dull Gray |
| 2 | 0 | 0.0000 | | Dull Gray |
| 3 | 1.9 | 12.3880 | | Dull Gray |
| 1200 ppm Detergent, 15% GD Silicate | | | | |
| 10 | 0.5 | 3.2600 | −1.3040 | Shiny Gray |
| 11 | 0.2 | 1.3040 | | Shiny Gray |
| 12 | −1.3 | −8.4760 | | Shiny Gray |
| 1200 ppm Detergent, 20% GD Silicate | | | | |
| 13 | 0.1 | 0.6520 | −0.4347 | Shiny Gray |
| 14 | −0.1 | −0.6520 | | Shiny Gray |
| 15 | −0.2 | −1.3040 | | Shiny Gray |
| 1200 ppm Caustic Detergent, With Silicate | | | | |
| 22 | 42.4 | 276.4480 | 282.0987 | Brown/Gray |
| 23 | 44 | 286.8800 | | Brown/Gray |
| 24 | 43.4 | 282.9680 | | Brown/Gray |

TABLE 6-continued

| METAL CORROSION - ALUMINUM NON-CLAD COUPONS | | | | |
|---|---|---|---|---|
| % SOLUTION | WT. LOSS (mg) | CORROSION RATE mils/yr | AVG C. RATE mils/yr | FINAL APPEARANCE |
| 2000 ppm Caustic Detergent, With Silicate | | | | |
| 25 | 2.4 | 15.6480 | 14.7787 | Gray |
| 26 | 2.1 | 13.6920 | | Gray |
| 27 | 2.3 | 14.9960 | | Gray |

EXAMPLE 3

Enhanced Solidification With $K^+$ Salt of HEDP

The solid block of the invention was made by preparing the premixes shown below with the extrusion procedures above. A simulated extrusion was performed on a laboratory scale by mixing the premixes in order and packing and then permitting the materials to solidify in a container. Alternatively, the premixes were mixed together and compressed into tablets.

KOH or mixed KOH/NaOH can be used to neutralize the liquid phosphonic acid 1-hydroxyl ethylidine-1,1-diphosphonic acid (Dequest 2010/Briquest ADPA). Interestingly, a $K^+$ salt of Dequest 2010/Briquest ADPA is exemplified by the formula shown below. The lab simulation of the extrusion of this formula produced excellent results—firm after 5 minutes and solid after 10 minutes. Most significantly, the pressed tablets have not swelled or cracked after 7 days.

| PREMIX | FORMULA % | TOTAL WATER |
|---|---|---|
| Premix 1: | | |
| Water | 0.0 | 0.0 |
| KOH, 45% | 8.0 | 4.4 |
| Dequest 2010 (1-hydroxyethylidene-1,1-phosphonic acid) | 5.5 | 2.2 |
| Water from Neut. | | 1.2 |
| Premix 2: | | |
| Powder Premix | 31.8 | |
| Premix 3: | | |
| Nonionic | 2.7 | |
| Premix 4: | | |
| $Na_2CO_3$ | 34.5 | |
| Silicate - $Na_2O:SiO_2$ (1:2) (18 wt % water of hydration) | 17.500 | |
| TOTAL | 100.00 | |

| POWDER PREMIX Ingredients | Wt % |
|---|---|
| Granular Sodium Tripolyphosphate | 94.2 |
| Nonionic | 3.6 |
| Stearic monoethanolamide | 0.6 |
| Silicone Surfactant | 1.6 |

EXAMPLE 4

Using the procedure of Example 3, the following premix preparations were combined to form a solid block detergent.

| PREMIX | FORMULA % |
|---|---|
| Premix 1: | |
| Water | 0.0 |
| KOH, 45% | 8.0 |
| 1-hydroxyethylidene-1,1-phosphonic acid (Briquest ADPA 60AW) | 5.5 |
| Premix 2: | |
| Powder Premix[1] | 31.8 |
| Premix3: | |
| nonionic surfactant | 2.7 |
| Premix 4: | |
| Dense Ash-$Na_2CO_3$ | 34.4 |
| $Na_2O:SiO_2$ (1:2)-18 wt % water of hydration-granular-Britesil H-20 | 17.5 |
| TOTAL | 100.0 |

[1]See Example 3

The combined materials were extruded as described in Example 1 and rapidly solidified in about 5 minutes to form a solid block detergent that was dimensionally stable (did not swell) and provided excellent warewashing properties with aluminum metal protection.

Generally the carbonate/silicate compositions of the invention tested for aluminum corrosion have corrosion levels less than 10 mils per year which is a substantial improvement over typical caustic based detergents that can corrode aluminum at a rate of greater than 500 mils per year. Further, the metal protecting compositions of the invention maintain a shiny gray appearance when used at a level greater than about 12.5%, preferably greater than 15 wt % of the solid detergent material. The anticorrosion effect and the cleaning effect of the detergents appear to be most marked at concentrations of total detergent that is greater than about 600 ppm. The corrosion protecting detergents of the invention clearly provide excellent cleaning. The cleaning results from the carbonate silicate alkalinity source, the nonionic and silicone surfactants and the water conditioning agents. We have found that the solid block detergents of the invention are stable non-swelling blocks, dispensed uniformly without substantial excess or lack of effective detergent during dispensing from typical water spray-on dispensers.

The foregoing specification, examples and data provide a sound basis for understanding the specific embodiments of the invention disclosed in the invention. Since the invention can comprise a variety of embodiments, the invention resides in the claims hereinafter appended.

We claim:

1. A solid block warewashing detergent composition comprising a continuous extruded or cast solid composition, the composition comprising:

(a) about 10 to 80 wt % of $Na_2CO_3$;

(b) an alkali metal silicate having a $M_2O:SiO_2$ ratio of about 1:1 to 1:5; and (c) an effective amount of an organic phosphonate hardness sequestering agent comprising a potassium salt;

wherein the composition provides metal protection and hardens to a solid form within about 1 minute to about 20 minutes, and the block comprises about 5 to 20 wt % anhydrous sodium carbonate and a binding agent comprising sufficient amounts of hydrated sodium carbonate and phosphonate comprising a potassium salt, to form the solid block detergent, and wherein the block comprises either no second source of alkalinity or less than a solidification interfering amount of a second source of alkalinity.

2. The composition of claim 1 wherein the alkali metal silicate has a water content of about 5 to 25 wt %.

3. The composition of claim 1 wherein the block comprises about 0.1 to less than about 2.0 moles of water per mole of sodium carbonate.

4. The block of claim 3 wherein there are less than about 1.7 moles of water per mole of sodium carbonate.

5. The composition of claim 1 wherein the hydrated sodium carbonate comprises a monohydrate and the detergent comprises about 1.5 to 15 wt % of a surfactant composition comprising an anionic surfactant, a nonionic polymeric surfactant or mixture thereof.

6. The block of claim 1 wherein the composition is extruded to form the block.

7. The composition of claim 1 wherein the block has a mass greater than about 10 gms.

8. The block of claim 1 wherein the organic phosphonate sequestrant comprises about 0.5 to 20 wt % of a potassium phosphonate.

9. The block of claim 7 wherein the sequestrant also comprises an inorganic condensed phosphate.

10. The block of claim 8 wherein the sequestrant comprises about 3 to 20 wt % of the organic phosphonate and additionally comprises a tripolyphosphate sequestrant.

11. The block of claim 1 wherein the solid block is substantially free of NaOH.

12. The block of claim 1 wherein the silicate comprises $Na_2O:SiO_2$ of about 1:1.5 to 1:2.5.

13. The block of claim 1 wherein the block comprises about 10 to 30 wt % of the alkali metal silicate.

14. A method of cleaning ware with a metal protecting anticorrosion alkaline detergent, the method comprising:

(a) contacting ware with a continuous extruded or cast solid composition which hardens to a solid form within about 1 minute to about 20 minutes comprising an alkaline solid block warewashing detergent comprising about 20 to 60 wt % of $Na_2CO_3$; about 10 to 30 wt % of an alkali metal silicate having an $M_2O:SiO_2$ ratio of about 1:1 to 1:5; and about 0.1 to 20 wt % of an organic phosphonate hardness sequestering agent comprising a potassium salt; the block comprising about 5 to 20 wt % anhydrous sodium carbonate and a binding agent comprising sufficient amounts of hydrated sodium carbonate and a potassium phosphonate to form the solid block detergent; wherein the block comprises either no second source of alkalinity or less than a solidification interfering amount of a second source of alkalinity, creating washed ware while protecting metal ware from corrosion; and (b) rinsing the washed ware.

15. The method of claim 14 wherein the concentration of the detergent in the aqueous alkaline detergent comprises about 100 parts of detergent to about 2500 parts of detergent per each one million parts by weight of the aqueous detergent.

16. The method of claim 15 wherein the alkali metal silicate has a water content of about 5 to 25 wt %.

17. The method of claim 15 wherein the alkali metal silicate has a $M_2O:SiO_2$ of about 1:1.5 to about 1:2.5.

18. The method of claim 14 wherein the detergent comprises about 15 to about 30 wt % of the alkali metal silicate having an $M_2O:SiO_2$ ratio of about 1:2 and a water content of about 15 to 20 wt %.

* * * * *